US011473487B2

(12) United States Patent
Inoue

(10) Patent No.: US 11,473,487 B2
(45) Date of Patent: Oct. 18, 2022

(54) SYSTEM FOR PERFORMING FLUSHING THROUGH COOLING WATER PATHWAY IN MARINE PROPULSION DEVICE

(71) Applicant: YAMAHA HATSUDOKI KABUSHIKI KAISHA, Iwata (JP)

(72) Inventor: Hiroshi Inoue, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 564 days.

(21) Appl. No.: 16/590,452

(22) Filed: Oct. 2, 2019

(65) Prior Publication Data

US 2020/0149460 A1 May 14, 2020

(30) Foreign Application Priority Data

Nov. 12, 2018 (JP) ..... JP2018-211968

(51) Int. Cl.

| | |
|---|---|
| ***F01P 3/20*** | (2006.01) |
| ***B63H 20/28*** | (2006.01) |
| ***B63J 99/00*** | (2009.01) |
| ***B63B 79/00*** | (2020.01) |
| ***F01P 3/00*** | (2006.01) |

(52) U.S. Cl.

CPC ..... *F01P 3/205* (2013.01); *B63H 20/28* (2013.01); *B63J 99/00* (2013.01); *B63B 79/00* (2020.01); *F01P 2003/001* (2013.01)

(58) Field of Classification Search

CPC ..... F01P 3/205; F01P 2003/001; B63H 20/28; B63H 20/00; B63J 99/00; B63B 79/00

See application file for complete search history.

(56) References Cited

U.S. PATENT DOCUMENTS

| | | | | |
|---|---|---|---|---|
| 9,517,495 | B1 | 12/2016 | Napurano et al. | |
| 2003/0114053 | A1 | 6/2003 | Hahn et al. | |
| 2007/0105464 | A1 | 5/2007 | Vasilaros | |
| 2007/0107421 | A1* | 5/2007 | Emmert | F16H 61/4148 60/435 |
| 2008/0295540 | A1* | 12/2008 | Kunz | B23Q 11/122 62/515 |

FOREIGN PATENT DOCUMENTS

WO 2016/028474 A1 2/2016

* cited by examiner

*Primary Examiner* — Stephen P Avila

(74) *Attorney, Agent, or Firm* — Keating and Bennett, LLP

(57) ABSTRACT

A system for flushing a cooling water pathway of a marine propulsion device with water supplied from a water source includes a water control device and a controller. The water control device is connected to the water source and the cooling water pathway of the marine propulsion device. The controller controls and causes the water control device to supply the water from the water source to the cooling water pathway so as to perform the flushing. The controller obtains propulsion device data including at least one of a pressure of the water, a flow rate of the water and a concentration of salt contained in the water in the cooling water pathway. The controller determines whether or not to stop a supply of the water by the water control device based on the propulsion device data.

11 Claims, 11 Drawing Sheets

| TILT ANGLE [deg.] | WATER PRESSURE [kPa] | | | | | |
|---|---|---|---|---|---|---|
| | 0 | 10 | 20 | 30 | 40 | 50 |
| 0 | × | × | × | 10 min. | 8 min. | 5 min. |
| 10 | × | × | × | 10 min. | 8 min. | 5 min. |
| 20 | × | × | × | 10 min. | 8 min. | 4 min. |
| 30 | × | × | × | 10 min. | 8 min. | 4 min. |
| 40 | × | × | 10 min. | 8 min. | 5 min. | 3 min. |
| 50 | × | × | 10 min. | 8 min. | 5 min. | 3 min. |
| 60 | × | × | 10 min. | 8 min. | 5 min. | 3 min. |

FIG. 7

SYSTEM FOR PERFORMING FLUSHING THROUGH COOLING WATER PATHWAY IN MARINE PROPULSION DEVICE

CROSS REFERENCE TO RELATED APPLICATIONS

This application claims the benefit of priority to Japanese Patent Application No. 2018-211968 filed on Nov. 12, 2018. The entire contents of this application are hereby incorporated herein by reference.

BACKGROUND OF THE INVENTION

1. Field of the Invention

The present invention relates to a system for flushing a cooling water pathway in a marine propulsion device with water supplied from a water source.

2. Description of the Related Art

A marine propulsion device is required to perform a process called "flushing" after being used in sea water. Flushing is performed for washing out sea water with fresh water flowing through a cooling water pathway for an engine in the marine propulsion device. The engine is provided with a connection port connected to the cooling water pathway. When performing flushing, a hose extended from a water source (a water supply, a tank, etc.) is connected to the connection port.

U.S. Pat. No. 9,517,495 discloses a system for automatically performing flushing. The system disclosed in U.S. Pat. No. 9,517,495 includes a timer control unit, a start switch and a plurality of solenoid valves. When the start switch is pushed, the timer control unit sequentially opens and closes the plurality of solenoid valves at constant time intervals. Accordingly, flushing is performed for a marine propulsion device.

Chances are that flushing is not sufficiently performed when the flushing time is short. In this case, salt contained in sea water remains in the engine, and inevitably, reduces the product life of the engine. However, an appropriate time for flushing depends on factors such as the pressure of water in the water source or the status of the marine propulsion device. Therefore, it is difficult for a user to know the appropriate time for flushing. Because of this, for instance in practical situations, flushing time is extremely long such that flushing can be sufficiently performed even at a low water pressure.

SUMMARY OF THE INVENTION

Preferred embodiments of the present invention perform flushing of marine propulsion devices in a short time.

A system according to a preferred embodiment of the present invention flushes a cooling water pathway of a marine propulsion device with water supplied from a water source, and includes a water control device and a controller. The water control device is connected to the water source and the cooling water pathway of the marine propulsion device. The water control device controls a supply of the water from the water source to the cooling water pathway. The controller controls the water control device. The controller controls and causes the water control device to supply the water from the water source to the cooling water pathway so as to flush the cooling water pathway. The controller obtains propulsion device data. The propulsion device data includes at least one of a pressure of the water in the cooling water pathway, a flow rate of the water in the cooling water pathway, and a concentration of salt contained in the water in the cooling water pathway. The controller determines whether or not to stop the supply of the water with the water control device based on the propulsion device data.

According to a preferred embodiment of the present invention, the controller starts flushing by controlling the water control device, and thereafter, determines whether or not to stop the supply of the water with the water control device based on the propulsion device data. The propulsion device data includes at least one of the pressure of the water in the cooling water pathway, the flow rate of the water in the cooling water pathway, and the concentration of salt contained in the water in the cooling water pathway. Because of this, the controller is able to determine an appropriate time to stop the supply of the water with the water control device based on the propulsion device data. Accordingly, flushing of the cooling water pathway is able to be performed in a short time.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 7 is a table showing exemplary required time data.

DETAILED DESCRIPTION OF THE PREFERRED EMBODIMENTS

Figure 1:
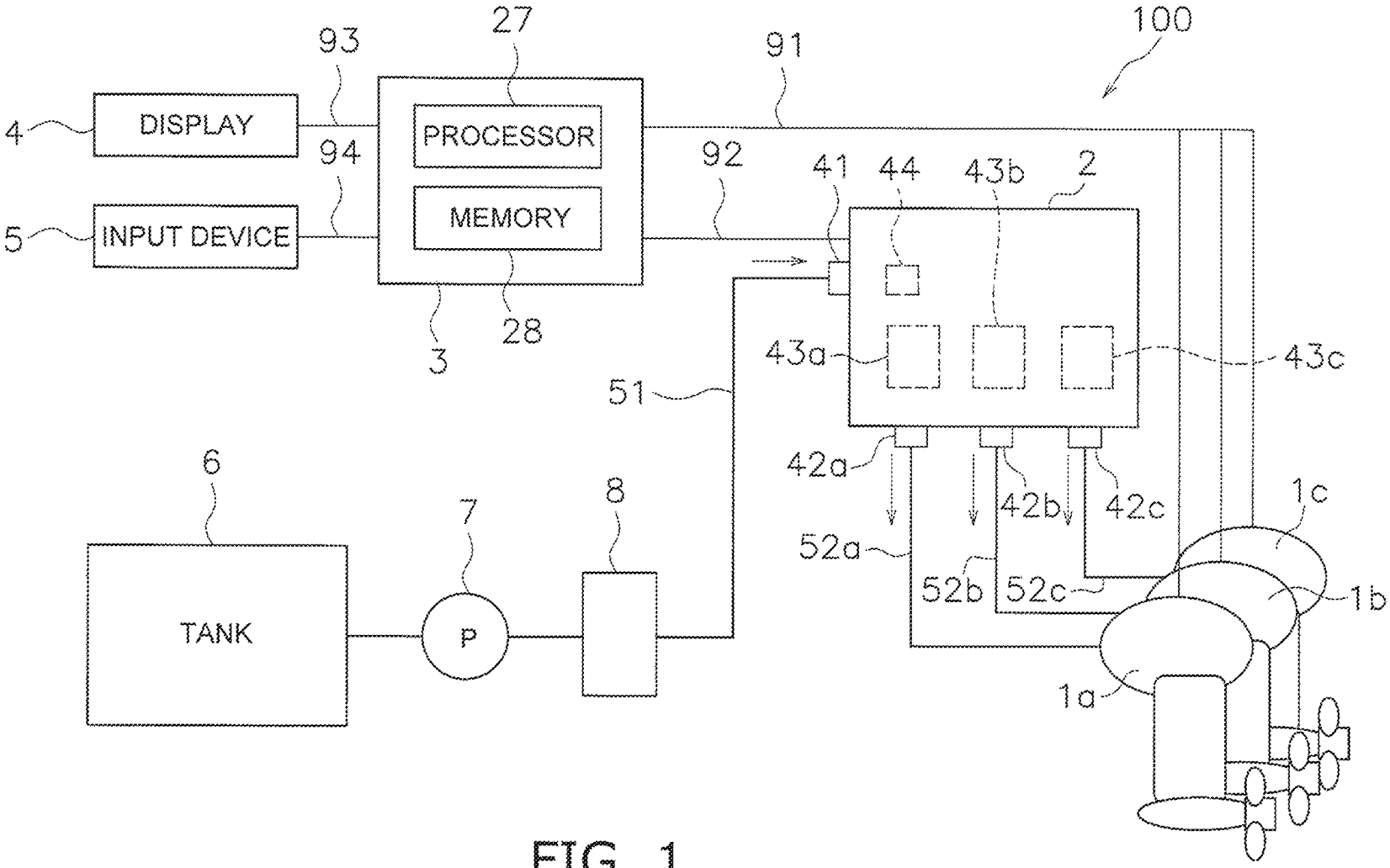
FIG. 1 is a diagram showing a configuration of a system according to various preferred embodiments of the present invention.

Preferred embodiments of the present invention will be hereinafter explained with reference to drawings. FIG. 1 is a schematic diagram showing a system 100 according to various preferred embodiments of the present invention. The system 100 flushes cooling water pathways in marine propulsion devices 1*a* to 1*c* with water supplied from a water source. In the present preferred embodiment, the marine propulsion devices 1*a* to 1*c* are outboard motors, for example. It should be noted that in preferred embodiments of the present invention, the system 100 preferably automatically flushes the plurality of marine propulsion devices 1*a* to 1*c*. The plurality of marine propulsion devices 1*a* to 1*c* include a first marine propulsion device 1*a*, a second marine propulsion device 1*b*, and a third marine propulsion device 1*c*. However, the system 100 may flush less than or more than three marine propulsion devices. The system 100 may flush a single marine propulsion device.

Figure 2:
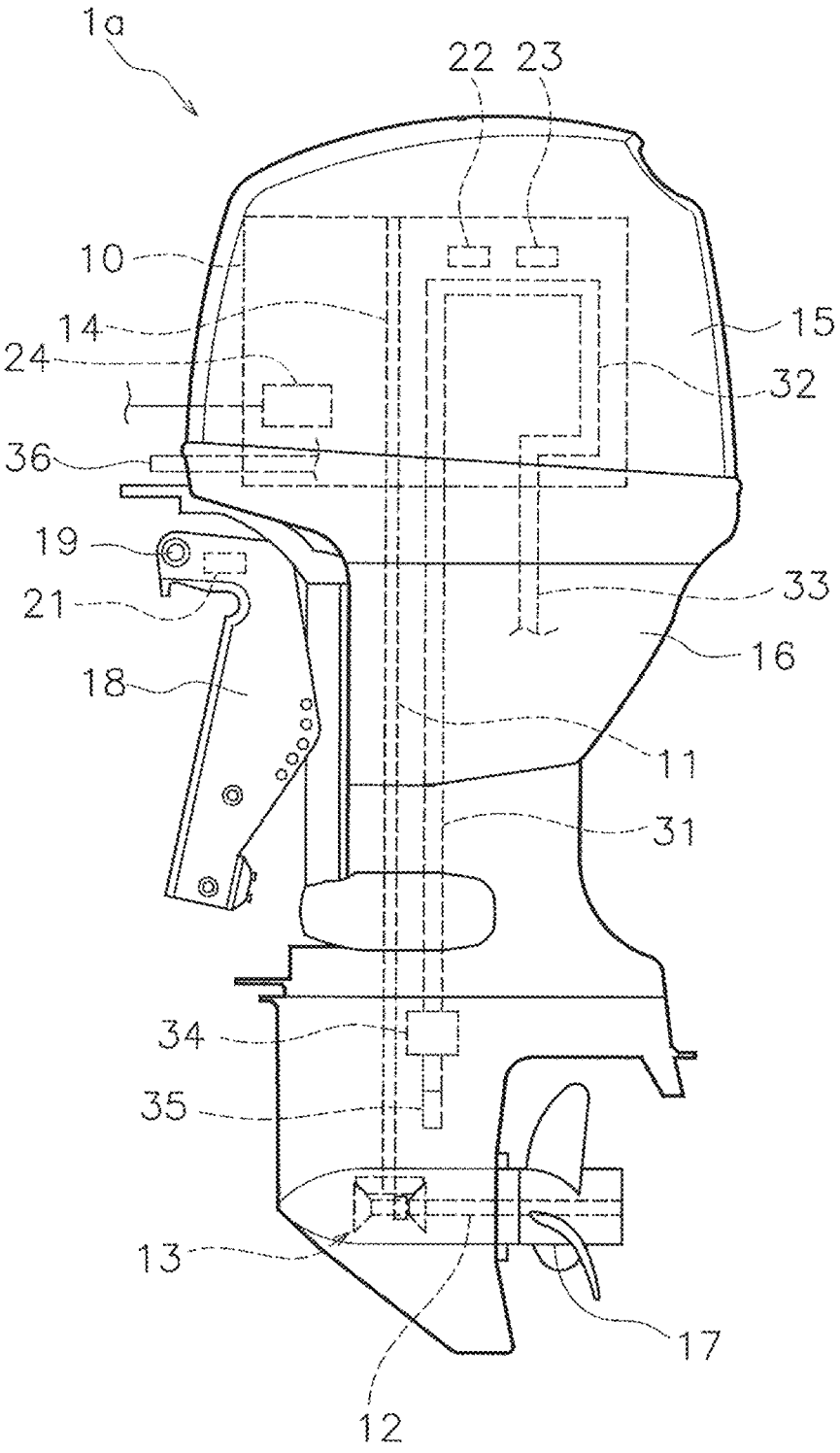
FIG. 2 is a side view of a marine propulsion device according to a first preferred embodiment of the present invention.

FIG. 2 is a side view of the first marine propulsion device 1*a*. As shown in FIG. 2, the first marine propulsion device 1*a* includes an engine 10, a drive shaft 11, a propeller shaft 12, and a shift mechanism 13. The engine 10 generates a thrust to propel a watercraft. The engine 10 includes a crankshaft 14. The crankshaft 14 extends in the vertical direction. The drive shaft 11 is connected to the crankshaft 14. The drive shaft 11 extends in the vertical direction. The drive shaft 11 extends downwardly from the engine 10.

The propeller shaft 12 extends in the back-and-forth direction of the first marine propulsion device 1*a*. The propeller shaft 12 is connected to the drive shaft 11 through the shift mechanism 13. A propeller 17 is connected to the propeller shaft 12. The shift mechanism 13 switches a rotational direction of power to be transmitted from the drive shaft 11 to the propeller shaft 12. The shift mechanism 13 includes, for instance, a plurality of gears and a clutch that changes meshing of the gears.

The first marine propulsion device 1*a* includes a cowl 15 and a housing 16. The cowl 15 accommodates the engine 10. The housing 16 is disposed below the cowl 15. The housing 16 accommodates the drive shaft 11 and the propeller shaft 12. The first marine propulsion device 1*a* includes a bracket 18. The first marine propulsion device 1*a* is attached to the watercraft through the bracket 18. The bracket 18 includes a trim and tilt shaft 19. The trim and tilt shaft 19 extends in the right-and-left direction. The bracket 18 supports the first marine propulsion device 1*a* such that the first marine propulsion device 1*a* is rotatable about the trim and tilt shaft 19. The bracket 18 is provided with an angle sensor 21. The angle sensor 21 detects the tilt angle of the first marine propulsion device 1*a*. The angle sensor 21 outputs a signal indicating the tilt angle.

The first marine propulsion device 1*a* includes a supply water pathway 31, a cooling water pathway 32, a discharge water pathway 33, and a water pump 34. It should be noted that FIG. 2 schematically shows the respective water pathways 31 to 33. The supply water pathway 31 is disposed inside the housing 16. The supply water pathway 31 is connected to an inlet 35 provided in the housing 16. The water pump 34 is connected to the supply water pathway 31. The water pump 34 sucks water through the inlet 35 and supplies the water to the supply water pathway 31.

The cooling water pathway 32 is provided inside the engine 10. The cooling water pathway 32 may be provided in a member such as an exhaust pipe or an oil cooler disposed in the surroundings of the engine 10. The cooling water pathway 32 is connected to the supply water pathway 31. The engine 10 is cooled by water flowing through the cooling water pathway 32. The discharge water pathway 33 is disposed inside the housing 16. The discharge water pathway 33 is connected to an outlet (not shown in the drawings) provided in the housing 16. The water, flowing through the cooling water pathway 32, is discharged to the outside of the first marine propulsion device 1*a* through the discharge water pathway 33. Additionally, the first marine propulsion device 1*a* includes a connecting port 36. The connecting port 36 is connected to the cooling water pathway 32.

The first marine propulsion device 1*a* includes a water pressure sensor 22 and a water temperature sensor 23. The water pressure sensor 22 detects the pressure of water in the cooling water pathway 32. The water pressure sensor 22 outputs a signal indicating the pressure of water in the cooling water pathway 32. The water temperature sensor 23 detects the temperature of water in the cooling water pathway 32. The water temperature sensor 23 outputs a signal indicating the temperature of water in the cooling water pathway 32.

The first marine propulsion device 1*a* includes an ECU (Engine Control Unit). The ECU 24 electrically controls the engine 10. The ECU 24 includes a processor such as a CPU and memories such as a RAM and a ROM, for example. The ECU 24 communicates with the above-described sensors including the angle sensor 21, the water pressure sensor 22, and the water temperature sensor 23. The ECU 24 receives signals transmitted thereto from the sensors. Each of the other marine propulsion devices 1*b* and 1*c* is preferably configured the same or substantially the same as the first marine propulsion device 1*a*.

As shown in FIG. 1, the system 100 includes a water control device 2, a controller 3, a display 4, and an input device 5. The water control device 2 is connected to a tank 6 provided as a water source. The tank 6 stores fresh water. The water control device 2 is connected to the tank 6 through a pump 7 and an accumulator 8. The water control device 2 is connected to the cooling water pathways of the plurality of marine propulsion devices 1*a* to 1*c*. The water control device 2 includes an inlet 41, a plurality of outlets 42*a* to 42*c*, and a plurality of valves 43*a* to 43*c*. A hose 51, extended from the tank 6, is connected to the inlet 41. Hoses 52*a* to 52*c*, extended from the plurality of marine propulsion devices 1*a* to 1*c*, are connected to the plurality of outlets 42*a* to 42*c*, respectively. The hoses 52*a* to 52*c* are connected to the connecting ports of the marine propulsion devices 1*a* to 1*c*, respectively.

In the above-described preferred embodiment, the plurality of outlets 42*a* to 42*c* include a first outlet 42*a*, a second outlet 42*b*, and a third outlet 42*c*. It should be noted that the number of outlets may be less than three or may be greater than three. The plurality of valves 43*a* to 43*c* respectively correspond to the plurality of outlets 42*a* to 42*c*. The plurality of valves 43*a* to 43*c* are connected to the cooling water pathways of the plurality of marine propulsion devices 1*a* to 1*c* through the outlets 42*a* to 42*c*, respectively.

The plurality of valves 43*a* to 43*c* are preferably solenoid valves, for example, each of which is opened and closed in response to a command signal transmitted thereto from the controller 3. In the present preferred embodiment, the plurality of valves 43*a* to 43*c* include a first valve 43*a*, a second valve 43*b*, and a third valve 43*c*. It should be noted that similarly to the number of the outlets, the number of valves may be less than three or may be greater than three. The water control device 2 includes a water pressure sensor 44. The water pressure sensor 44 detects the pressure of water to be supplied to the inlet 41. The water pressure sensor 44 outputs a signal indicating the pressure of water to be supplied to the inlet 41.

When the first valve 43*a* is opened and the second and third valves 43*b* and 43*c* are closed, water is supplied from the tank 6 to the cooling water pathway of the first marine propulsion device 1*a* through the inlet 41 and the first outlet 42*a*. When the second valve 43*b* is opened and the first and third valves 43*a* and 43*c* are closed, water is supplied from the tank 6 to the cooling water pathway of the second marine propulsion device 1*b* through the inlet 41 and the second outlet 42*b*. When the third valve 43*c* is opened and the first and second valves 42*a* and 43*b* are closed, water is supplied from the tank 6 to the cooling water pathway of the third marine propulsion device 1*c* through the inlet 41 and the third outlet 42*c*.

The controller 3 is configured or programmed to control the water control device 2 based on obtained data. The controller 3 includes a processor 27 such as a CPU and memories 28 such as a RAM and a ROM, for example. The controller 3 communicates with the marine propulsion devices 1*a* to 1*c* and the water control device 2. The controller 3 is connected to the marine propulsion devices 1*a* to 1*c* and the water control device 2 through communication lines 91 and 92. The controller 3 may communicate with the marine propulsion devices 1*a* to 1*c* and/or the valves 43*a* to 43*c* by wireless communication. More specifically, the controller 3 is connected to the ECUs of the marine propulsion devices 1*a* to 1*c*. The controller 3 obtains a plurality of sets of propulsion device data regarding the plurality of marine propulsion devices 1*a* to 1*c* from the ECUs of the plurality of marine propulsion devices 1*a* to 1*c*.

Each set of propulsion device data includes the pressure of water and the temperature of water in the cooling water pathway of a corresponding marine propulsion device and the tilt angle of the corresponding marine propulsion device. Each set of propulsion device data includes an identification number of the marine propulsion device. The identification number is, for instance, the product number of the engine of the marine propulsion device. Additionally, each set of propulsion device data includes information indicating whether or not the engine is stopped. For example, the information, indicating whether or not the engine is stopped, is the rotational speed of the engine. The controller 3 sequentially opens and closes the plurality of valves 43*a* to 43*c* based on the plurality of sets of propulsion device data regarding the marine propulsion devices 1*a* to 1*c*. Accordingly, flushing is automatically performed of the cooling water pathways in the respective marine propulsion devices 1*a* to 1*c*.

The display 4 and the input device 5 communicate with the controller 3. The display 4 and the input device 5 are connected to the controller 3 through communication lines 93 and 94. The display 4 and the input device 5 may communicate with the controller 3 by wireless communication. The display 4 includes, for instance, an LCD (Liquid Crystal Display). However, the display 4 may be another type of display device such as an organic EL display, for example. The display 4 shows information indicating a status of flushing of a cooling water pathway in accordance with a command signal transmitted thereto from the controller 3.

The input device 5 receives an operational input by a user. The input device 5 outputs a signal indicating the operational input by the user. The controller 3 receives the signal indicating the operational input by the user. The input device 5 includes, for instance, a touchscreen. However, the input device 5 may be a device including at least one hardware key. The controller 3 starts automated flushing when a predetermined operation is performed in the input device 5.

Figure 3:
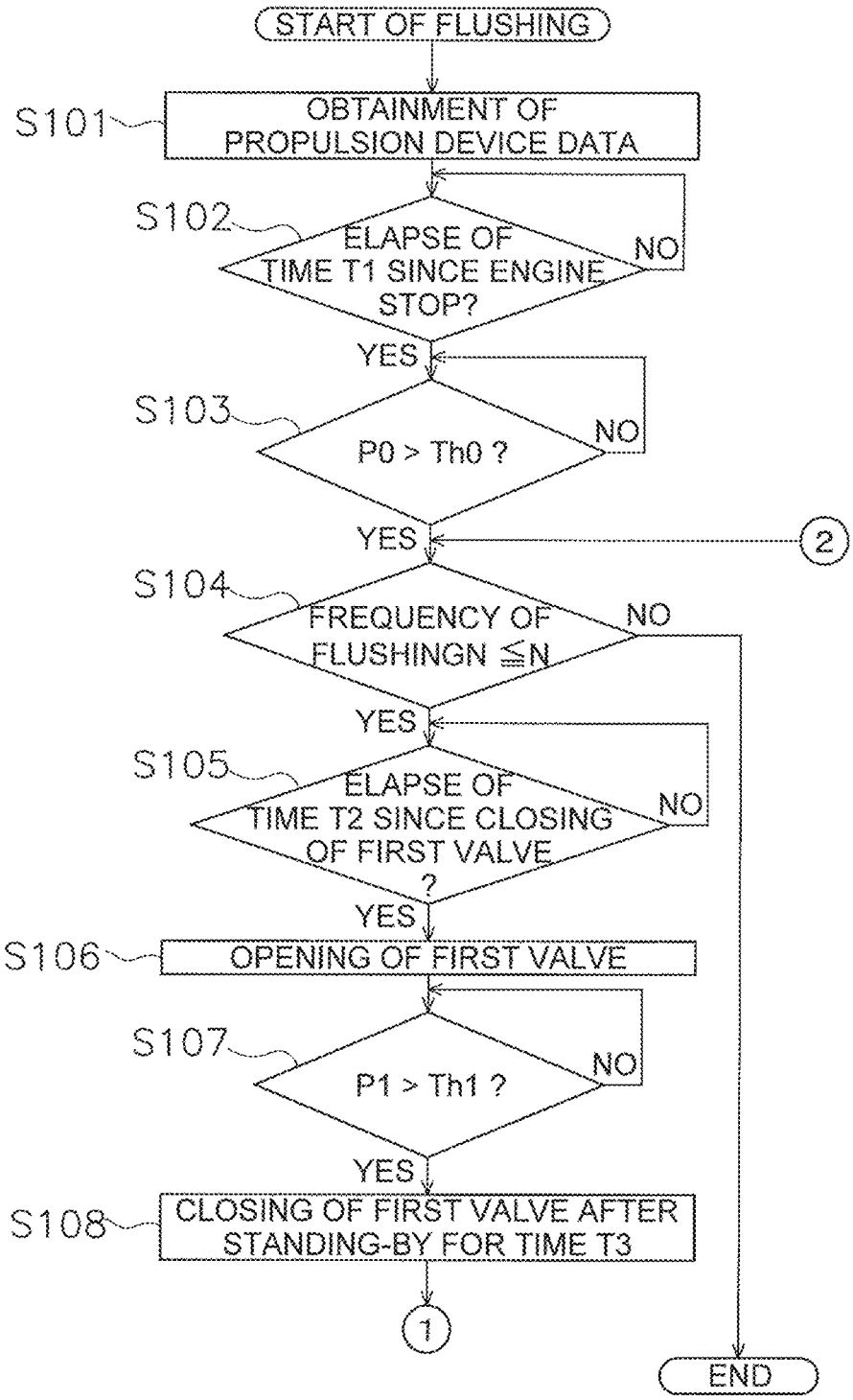
FIG. 3 is a flowchart showing a series of processes of automated flushing according to the first preferred embodiment of the present invention.
Figure 4:
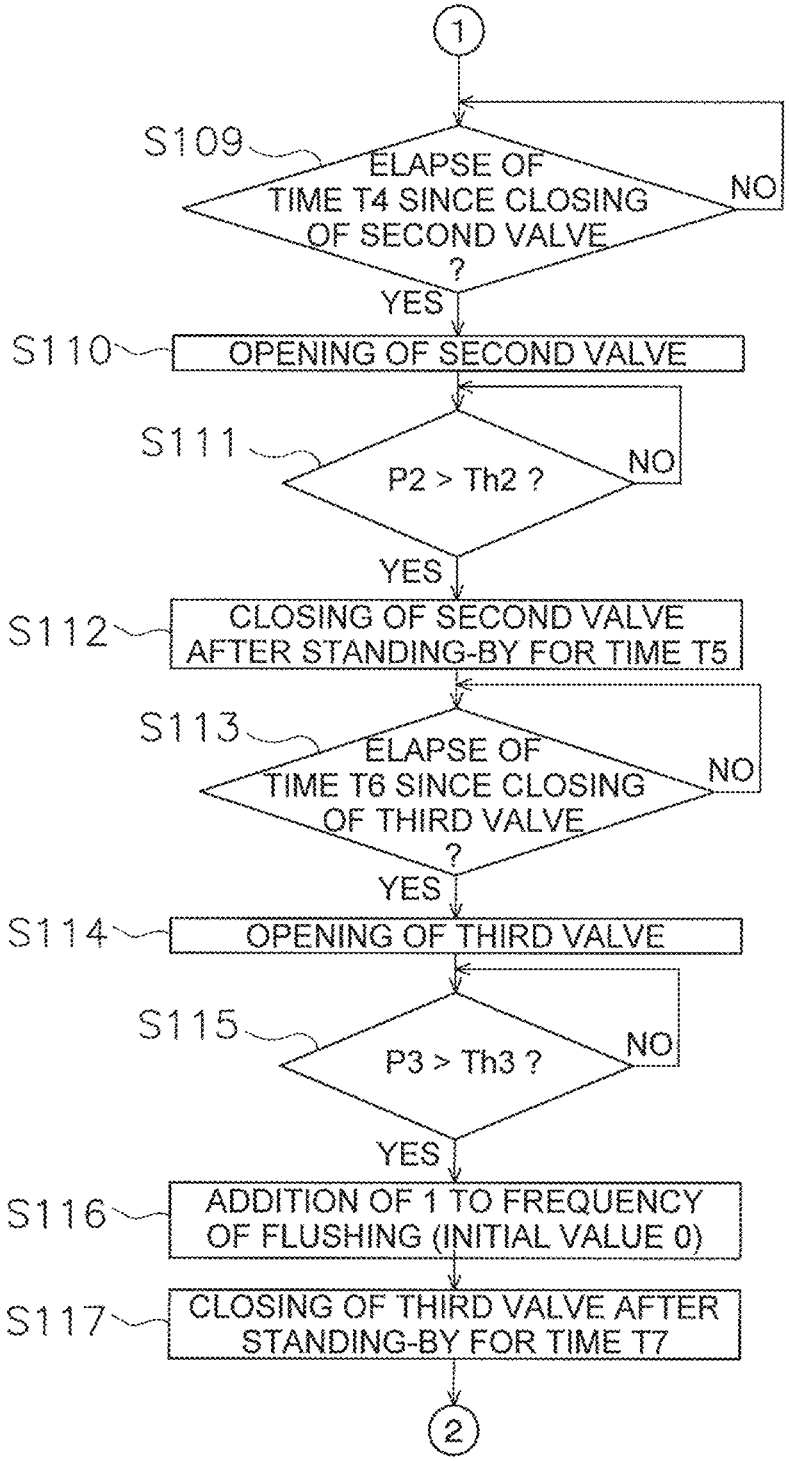
FIG. 4 is a flowchart showing a series of processes of the automated flushing according to the first preferred embodiment of the present invention.

A series of processes of automated flushing to be performed by the controller 3 will be hereinafter explained. FIGS. 3 and 4 are flowcharts showing the series of processes of automated flushing according to the first preferred embodiment. As shown in FIG. 3, in step S101, the controller 3 obtains the propulsion device data. The controller 3 obtains a plurality of sets of propulsion device data from the first to third marine propulsion devices 1*a* to 1*c*.

The controller 3 determines parameters, including time settings and thresholds to be used in the following explanation, based on an identification number. A unique identification number is set for each marine propulsion device, and is contained in each set of propulsion device data. For example, the controller 3 stores data indicating relationships between the identification numbers and parameter values. The controller 3 obtains the identification numbers from the sets of propulsion device data of the marine propulsion devices 1*a* to 1*c*, and determines the parameter values based on the identification number with reference to the above-described relational data. However, the parameter values may be constant. Alternatively, the parameter values may be changed by the input device 5.

In step S102, the controller 3 determines whether or not a period of time T1 has elapsed since the engine stopped. The controller 3 determines whether or not the period of time T1 has elapsed since all of the engines in the first to third marine propulsion devices 1*a* to 1*c* had stopped. The controller 3 does not open the first to third valves 43*a* to 43*c* until the period of time T1 elapses since the engine has stopped. Likewise, the controller 3 does not open the first to third valves 43*a* to 43*c* during operation of the engine. When the period of time T1 has elapsed since the engine has stopped, the process proceeds to step S103.

In step S103, the controller 3 determines whether or not a water pressure P0 in the inlet 41 of the water control device 2 is greater than a threshold Th0. The controller 3 determines whether or not the water pressure P0 has a magnitude required to perform flushing. When the water pressure P0 is greater than the threshold Th0, the process proceeds to step S104.

In step S104, the controller 3 determines whether or not frequency of flushing is less than or equal to a threshold N. When the frequency of flushing is less than or equal to the threshold N, the process proceeds to step S105. In step S105, the controller 3 determines whether or not a period of time T2 has elapsed since closing the first valve 43*a*. The controller 3 determines whether or not water has been sufficiently discharged from the cooling water pathway after previously performing flushing. When the period of time T2 has elapsed since closing the first valve 43*a*, the process proceeds to step S106.

In step S106, the controller 3 opens the first valve 43*a*. Accordingly, water is supplied from the tank 6 to the cooling water pathway of the first marine propulsion device 1*a*. Water is constantly discharged from the cooling water pathway of the first marine propulsion device 1*a*. When the first valve 43*a* is opened, the amount of water supplied to the cooling water pathway becomes greater than the amount of water discharged from the cooling water pathway. Because of this, the amount of water increases in the cooling water pathway, and the cooling water pathway is filled with water. Then in step S107, the controller 3 determines whether or not a water pressure P1 in the cooling water pathway of the first marine propulsion device 1*a* is greater than a threshold Th1. The controller 3 determines whether or not the cooling water pathway of the first marine propulsion device 1*a* has been sufficiently filled with water supplied from the tank 6. When the water pressure P1 is greater than the threshold Th1, the process proceeds to step S108. In step S108, the controller 3 stands by until elapse of a period of time T3, and then closes the first valve 43*a*. Due to closing the first valve 43*a*, the amount of water supplied to the cooling water pathway is stopped, such that water is discharged from the cooling water pathway of the first marine propulsion device 1*a*.

As shown in FIG. 4, in step S109, the controller 3 determines whether or not a period of time T4 has elapsed since closing the second valve 43*b*. When the period of time T4 has elapsed since closing the second valve 43*b*, the process proceeds to step S110. In step S110, the controller 3 opens the second valve 43*b*. Accordingly, water is supplied from the tank 6 to the cooling water pathway of the second marine propulsion device 1*b*. Then in step S111, the controller 3 determines whether or not a water pressure P2 in the cooling water pathway of the second marine propulsion device 1*b* is greater than a threshold Th2. The controller 3 determines whether or not the cooling water pathway of the second marine propulsion device 1*b* has been sufficiently filled with water supplied from the tank 6. When the water pressure P2 is greater than the threshold Th2, the process proceeds to step S112. In step S112, the controller 3 stands by until elapse of a period of time T5, and then closes the second valve 43*b*. Due to closing the second valve 43*b*, water is discharged from the cooling water pathway of the second marine propulsion device 1*b*.

In step S113, the controller 3 determines whether or not a period of time T6 has elapsed since closing the third valve 43*c*. When the period of time T6 has elapsed since closing the third valve 43*c*, the process proceeds to step S114. In step S114, the controller 3 opens the third valve 43*c*. Accordingly, water is supplied from the tank 6 to the cooling water pathway of the third marine propulsion device 1*c*. Then in step S115, the controller 3 determines whether or not a water pressure P3 in the cooling water pathway of the third marine propulsion device 1*c* is greater than a threshold Th3. The controller 3 determines whether or not the cooling water pathway of the third marine propulsion device 1*c* is sufficiently filled with water supplied from the tank 6. When the water pressure P3 is greater than the threshold Th3, the process proceeds to step S116. In step S116, the controller 3 adds "1" to the frequency of flushing. In step S117, the controller 3 stands by until elapse of a period of time T7, and then closes the third valve 43*c*. Due to closing the third valve 43*c*, water is discharged from the cooling water pathway of the third marine propulsion device 1*c*.

The process then returns to step S104, and the steps S104 to S117 are repeated until the frequency of flushing exceeds N. When the frequency of flushing exceeds N and reaches N+1, the controller 3 finishes the series of steps of automated flushing.

In the system 100 according to the present preferred embodiment, the controller 3 starts flushing of the first marine propulsion device 1*a* by opening the first valve 43*a*, and thereafter, determines whether or not to close the first valve 43*a* based on the propulsion device data of the first marine propulsion device 1*a*. The propulsion device data includes the pressure of water in the cooling water pathway of the first marine propulsion device 1*a*. Therefore, the controller 3 is able to determine the appropriate time to close the first valve 43*a* based on the propulsion device data. Because of this, flushing is sufficiently performed with a small amount of water in a short time.

Additionally, the controller 3 closes the first valve 43*a*, and thereafter, starts flushing of the second marine propulsion device 1*b* by opening the second valve 43*b*. The controller 3 closes the second valve 43*b*, and thereafter, starts flushing of the third marine propulsion device 1*c* by opening the third valve 43*c*. Because of this, flushing is automatically and sequentially performed for the plurality of marine propulsion devices 1*a* to 1*c* without changing which marine propulsion device the hose extended from the tank 6 is connected to.

Furthermore, similarly for each of the second and third marine propulsion devices 1*b* and 1*c*, the controller 3 determines whether or not to close each of the second and third valves 43*b* and 43*c* based on each of the sets of propulsion device data of the second and third marine propulsion devices 1*b* and 1*c*. Because of this, the controller 3 is able to determine the appropriate time to close each of the second and third valves 43*b* and 43*c*.

Figure 5:
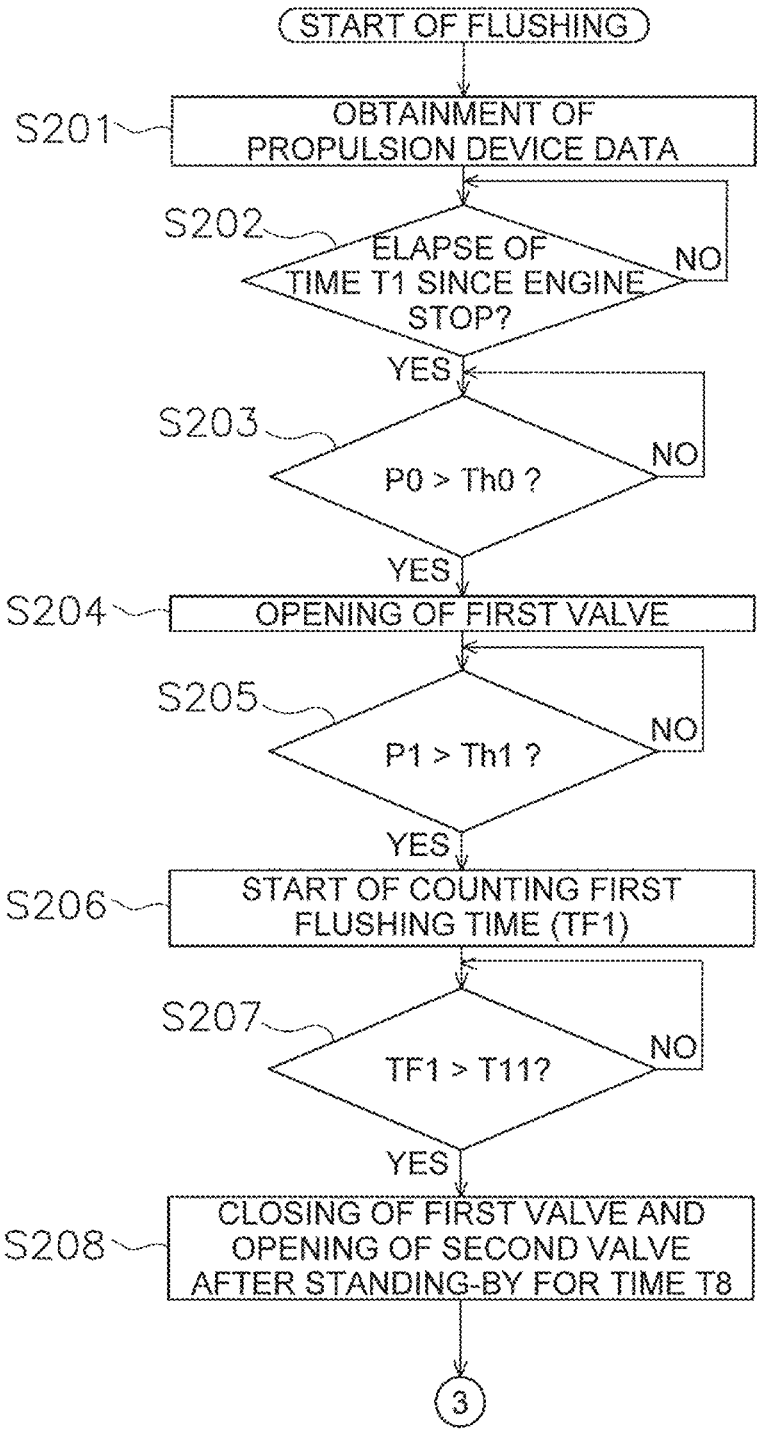
FIG. 5 is a flowchart showing a series of processes of automated flushing according to a second preferred embodiment of the present invention.
Figure 6:
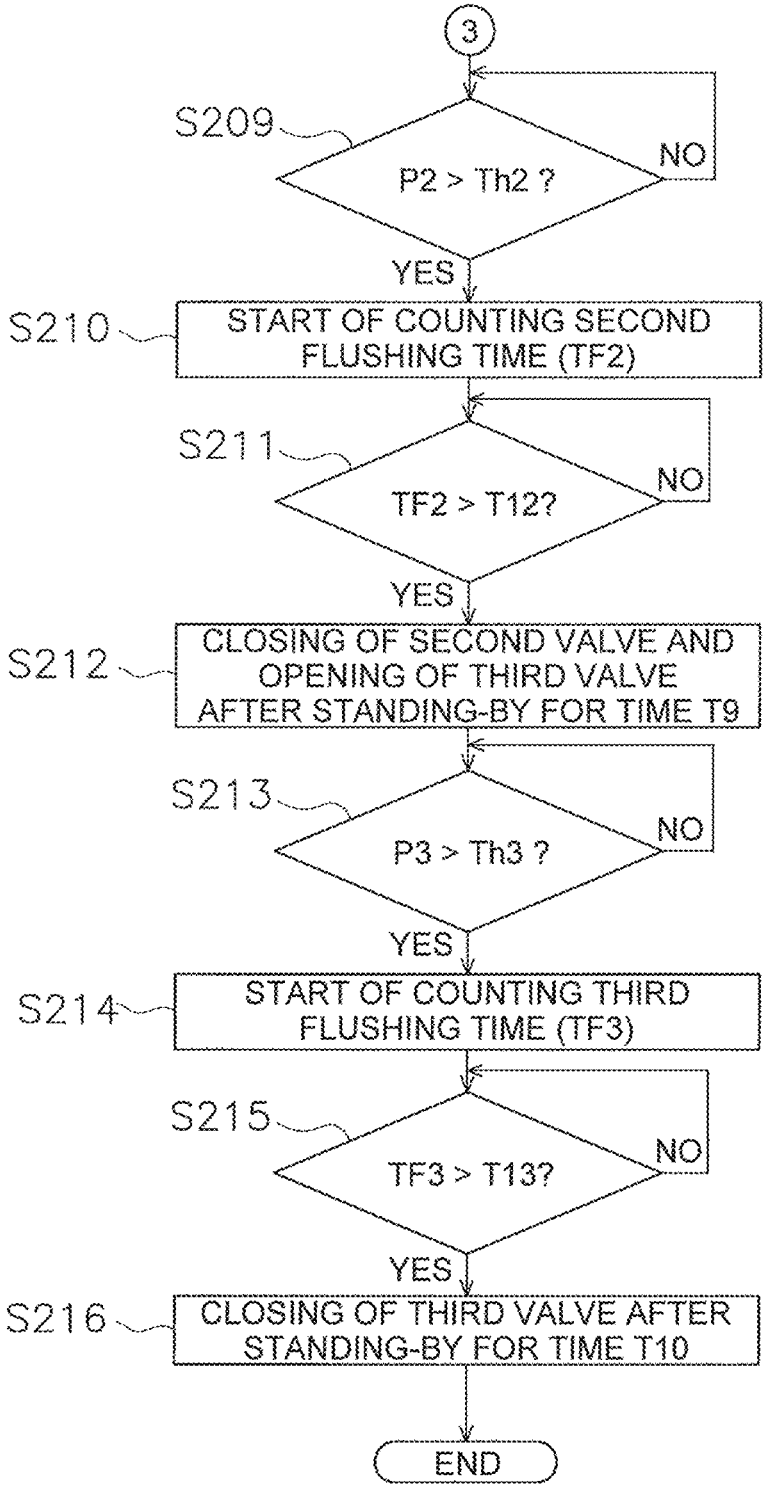
FIG. 6 is a flowchart showing a series of processes of the automated flushing according to the second preferred embodiment of the present invention.

Next, a series of processes of automated flushing according to a second preferred embodiment of the present invention will be explained. FIGS. 5 and 6 are flowcharts showing the automated flushing according to the second preferred embodiment. Steps S201 to S205 shown in FIG. 5 are the same as the steps S101 to S103, S106, and S107 described above, respectively. When determining that the water pressure P1 in the cooling water pathway of the first marine propulsion device 1*a* is greater than the threshold Th1 in step S205, the controller 3 starts counting first flushing time TF1 in step S205. The first flushing time TF1 is the duration of flushing of the first marine propulsion device 1*a*.

In step S207, the controller 3 determines whether or not the first flushing time TF1 has exceeded a first required time T11. The first required time T11 is a target duration of flushing of the first marine propulsion device 1*a*. The controller 3 stores required time data shown in FIG. 7. The required time data defines relationships among required time, the tilt angle of each marine propulsion device, and the pressure of water in the cooling water pathway of each marine propulsion device. The required time data may be provided in the form of a table as shown in FIG. 7 or, alternatively, may be provided in another form such as mathematical formula or so forth. The controller 3 may store a plurality of sets of required time data corresponding to the identification numbers of the marine propulsion devices.

In the required time data, the required time reduces with an increase in pressure of water in the cooling water pathway. In the required time data, the required time reduces with an increase in tilt angle. It should be noted that the posture of the marine propulsion device becomes closer to a horizontal direction with an increase in the tilt angle. The controller 3 determines the first required time T11 based on the tilt angle of the first marine propulsion device 1*a* and the pressure of water in the cooling water pathway with reference to the required time data. It should be noted that numeric values shown in FIG. 7 are exemplary only, and the present invention is not limited to those numeric values.

When the first flushing time TF1 exceeds the first required time T11, the process proceeds to step S208. In step S208, the controller 3 stands by until elapse of a period of time T8, and then, closes the first valve 43*a* while opening the second valve 43*b*.

In step S209, the controller 3 determines whether or not the water pressure P2 in the cooling water pathway of the second marine propulsion device 1*b* is greater than the threshold Th2. When the water pressure P2 is greater than the threshold Th2, the process proceeds to step S210. In step S210, the controller 3 starts counting second flushing time TF2. The second flushing time TF2 is the duration of flushing of the second marine propulsion device 1*b*.

In step S211, the controller 3 determines whether or not the second flushing time TF2 has exceeded a second required time T12. The second required time T12 is a target duration of flushing of the second marine propulsion device 1*b*. The controller 3 determines the second required time T12 based on the tilt angle of the second marine propulsion device 1*b* and the pressure of water in the cooling water pathway with reference to the required time data. When the second flushing time TF2 exceeds the second required time T12, the process proceeds to step S212. In step S212, the controller 3 stands by until elapse of a period of time T9, and then, closes the second valve 43*b* while opening the third valve 43*c*.

In step S213, the controller 3 determines whether or not the water pressure P3 in the cooling water pathway of the third marine propulsion device 1*c* is greater than the threshold Th3. When the water pressure P3 is greater than the threshold Th3, the process proceeds to step S214. In step S214, the controller 3 starts counting a third flushing time TF3. The third flushing time TF3 is the duration of flushing of the third marine propulsion device 1*c*.

In step S215, the controller 3 determines whether or not the third flushing time TF3 exceeds a third required time T13. The third required time T13 is a target duration of flushing of the third marine propulsion device 1*c*. The controller 3 determines the third required time T13 based on the tilt angle of the third marine propulsion device 1*c* and the pressure of water in the cooling water pathway with reference to the required time data. When the third flushing time TF3 exceeds the third required time T13, the controller 3 stands by until elapse of a period of time T10, and closes the third valve 43*c* in step S216 so as to end the automated flushing.

The flushing of the cooling water pathway is also sufficiently performed with a small amount of water in a short time by the series of processes of automated flushing according to the second preferred embodiment. Moreover, flushing is automatically and sequentially performed for the plurality of marine propulsion devices 1*a* to 1*c* without changing the marine propulsion device to which the hose extended from the tank 6 is connected. Furthermore, in the series of processes of automated flushing according to the second preferred embodiment, the required time of flushing is determined based on the pressure of water in the cooling water pathway of each marine propulsion device 1*a*, 1*b*, 1*c* and the tilt angle of each marine propulsion device 1*a*, 1*b*, 1*c*. Because of this, the time to end flushing is appropriately determined.

Figure 8:
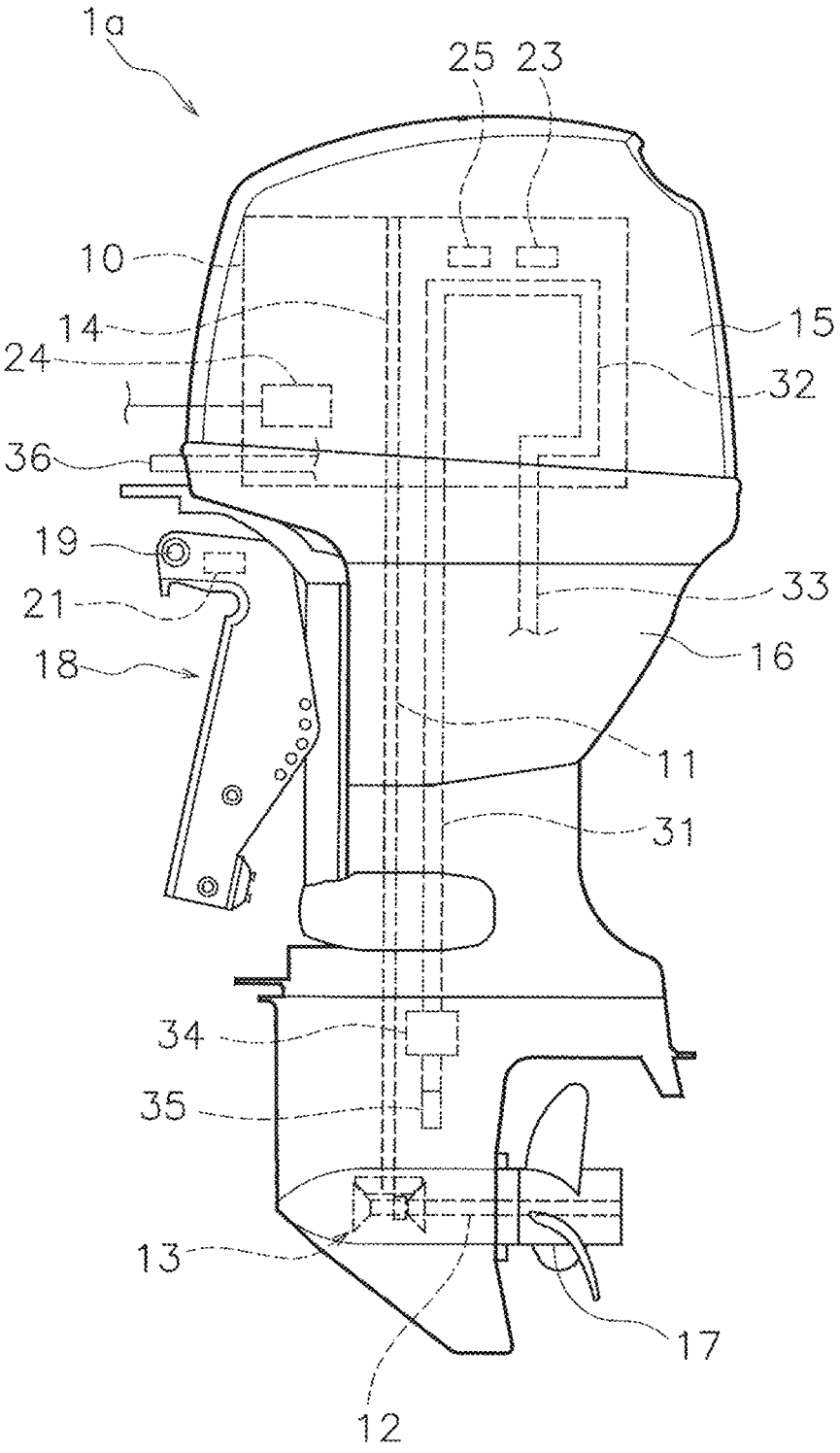
FIG. 8 is a side view of a marine propulsion device according to a third preferred embodiment of the present invention.

Next, a series of processes of automated flushing according to a third preferred embodiment of the present invention will be explained. As shown in FIG. 8, the first marine propulsion device 1*a* preferably includes a salt concentration sensor 25. The salt concentration sensor 25 detects the concentration of salt in the water in the cooling water pathway 32. The salt concentration sensor 25 outputs a signal indicating the concentration of salt in the water in the cooling water pathway 32. The salt concentration sensor 25 is, for instance, an electrical conductivity sensor. It should be noted that the salt concentration sensor 25 may be another type of sensor. The other marine propulsion devices 1*b* and 1*c* are configured similarly to the first marine propulsion device 1*a*.

Figure 9:
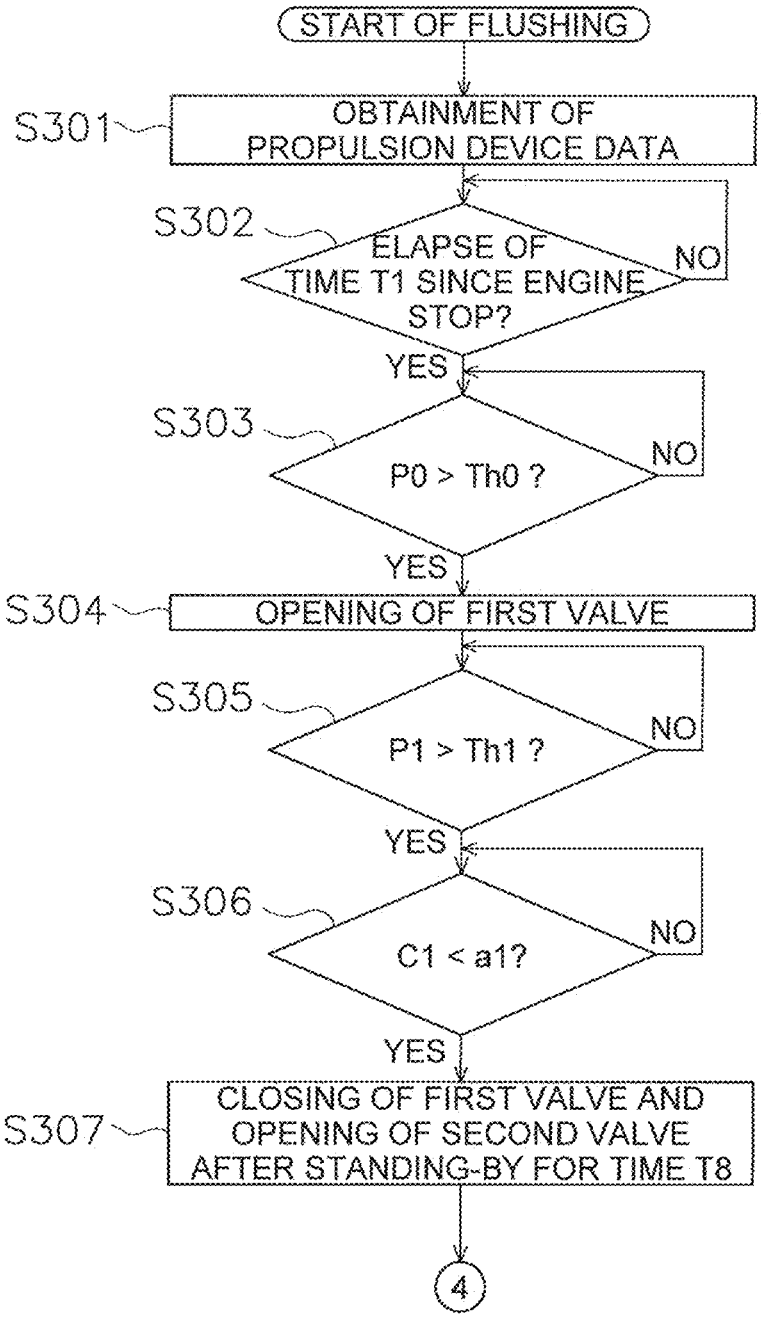
FIG. 9 is a flowchart showing a series of processes of automated flushing according to the third preferred embodiment of the present invention.
Figure 10:
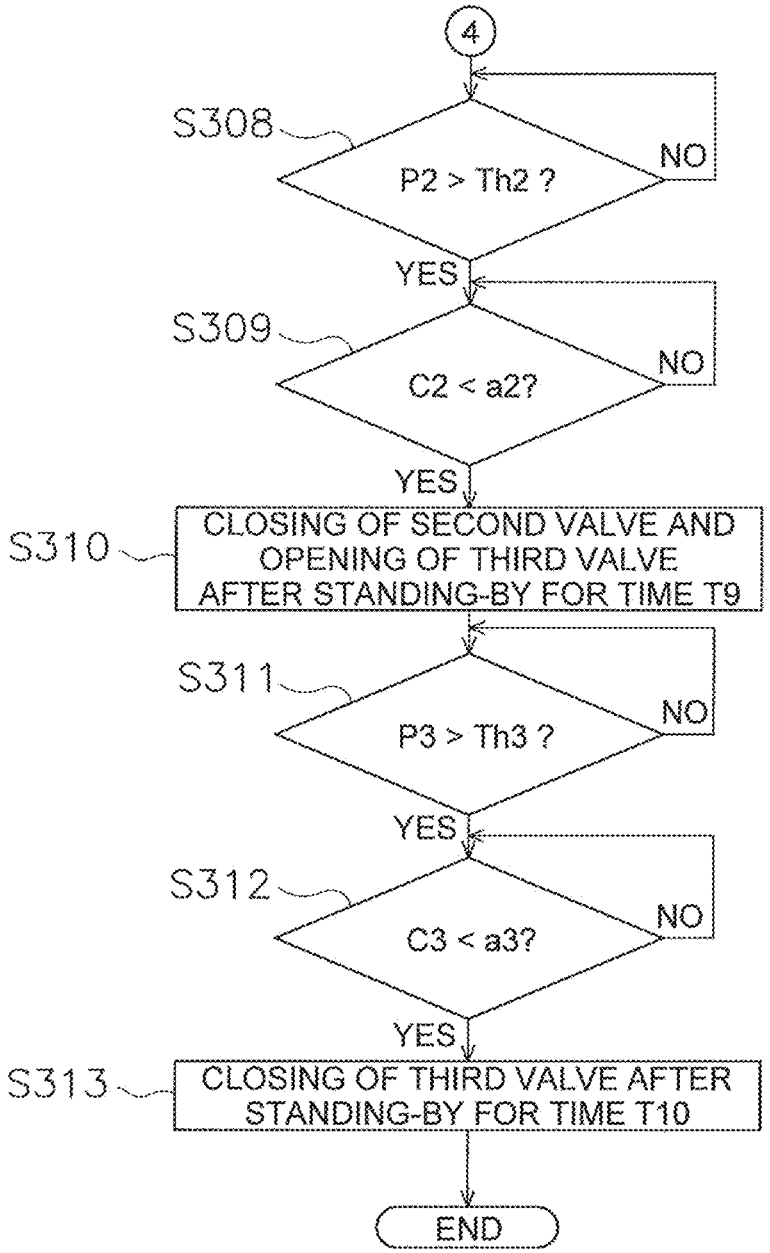
FIG. 10 is a flowchart showing a series of processes of the automated flushing according to the third preferred embodiment of the present invention.

The controller 3 obtains, as propulsion device data, the concentration of salt in the water in the cooling water pathway of each marine propulsion device 1*a*, 1*b*, 1*c*. In the series of processes of automated flushing according to the third preferred embodiment, the controller 3 determines whether or not to close each valve 43*a*, 43*b*, 43*c* based on the concentration of salt in the water in each marine propulsion device 1*a*, 1*b*, 1*c*. FIGS. 9 and 10 are flowcharts showing the series of processes of automated flushing according to the third preferred embodiment.

Steps S301 to S305 shown in FIG. 9 are the same as the steps S201 to S205 described above, respectively. When it is determined that the water pressure P1 in the cooling water pathway of the first marine propulsion device 1*a* in step S305 is greater than the threshold Th1, the controller 3 determines whether or not a first salt concentration C1 is less than a threshold a1 in step S306. The first salt concentration C1 is the concentration of salt in the water in the first marine propulsion device 1*a*. When the first salt concentration C1 is less than the threshold a1, the process proceeds to step S307. In step S307, the controller 3 stands by until elapse of the period of time T8, and then, closes the first valve 43*a* while opening the second valve 43*b*.

In step S308, the controller 3 determines whether or not the water pressure P2 in the cooling water pathway of the second marine propulsion device 1*b* is greater than the threshold Th2. When the water pressure P2 is greater than the threshold Th2, the process proceeds to step S309. In step S309, the controller 3 determines whether or not a second salt concentration C2 is less than a threshold a2. The second salt concentration C2 is the concentration of salt in the water in the cooling water pathway of the second marine propulsion device 1*b*. When the second salt concentration C2 is less than the threshold a2, the process proceeds to step S310. In step S310, the controller 3 stands by until elapse of a period of time T9, and then, closes the second valve 43*b* while opening the third valve 43*c*.

In step S311, the controller 3 determines whether or not the water pressure P3 in the cooling water pathway of the third marine propulsion device 1*c* is greater than the threshold Th3. When the water pressure P3 is greater than the threshold Th3, the process proceeds to step S312. In step S312, the controller 3 determines whether or not a third salt concentration C3 is greater than a threshold a3. The third salt concentration C3 is the concentration of salt in the water in the cooling water pathway of the third marine propulsion device 1*c*. When the third salt concentration C3 is less than the threshold a3, the controller 3 stands by until elapse of the period of time T10, and closes the third valve 43*c* in step S313 so as to end the automated flushing.

The flushing of the cooling water pathway is also sufficiently performed with a small amount of water in a short time by the series of processes of automated flushing according to the third preferred embodiment. Moreover, flushing is automatically and sequentially performed for the plurality of marine propulsion devices 1*a* to 1*c* without changing the marine propulsion device to which the hose extended from the tank 6 is connected. Furthermore, in the series of processes of automated flushing according to the third preferred embodiment, the time to close each valve 43*a*, 43*b*, 43*c* is determined based on the concentration of salt in the water in the cooling water pathway of each marine propulsion device 1*a*, 1*b*, 1*c*. Because of this, the time to end flushing is appropriately determined.

Preferred embodiments of the present invention have been explained above. However, the present invention is not limited to the above-described preferred embodiments, and a variety of changes can be made without departing from the gist of the present invention.

The marine propulsion devices are not limited to outboard motors, and alternatively, may be other types of marine propulsion devices such as inboard motors. The configuration of each marine propulsion device is not limited to that in the above-described exemplary preferred embodiments, and may be changed. The configuration of the flushing system is not limited to that in the above-described preferred embodiments, and may be changed. For example, in the above-described preferred embodiments, the tank 6 is preferably used as a water source. However, the water source is not limited to the tank 6, and alternatively, may be another water supply. In this case, the pump 7 may be omitted.

The configuration of the controller 3 is not limited to that in the above-described preferred embodiments, and may be changed. The controller 3 may be integrated with the water control device 2. The controller 3 may be integrated with the display 4 and/or the input device 5. The controller 3 may be the ECU 24. In other words, the ECU 24 may perform the series of processes of automated flushing performed by the controller 3 as described above.

The controller 3 may shut down the system 100 when it is determined to end the series of processes of automated flushing. For example, the controller 3 may automatically power off the controller 3. The controller 3 may automatically power off the water control device 2.

The controller 3 may control the pump 7 by communicating therewith. For example, the controller 3 may switch between driving and stopping of the pump 7 in accordance with opening and closing of the valves 43*a* to 43*c*. The controller 3 may start the pump 7 to start flushing. The controller 3 may stop the pump 7 to end flushing. The controller 3 may output a command signal to the ECU of each marine propulsion device so as to cause the ECU to prohibit cranking of the engine of each marine propulsion device during flushing.

The elements included in the water control device are not limited to valves, and may be other elements. For example, pumps may be included in the water control device, and correspond respectively to the marine propulsion devices. The controller 3 may control the supply of water to the cooling water pathway of each marine propulsion device by controlling each pump. In this case, the first to third valves 43*a* to 43*c* described above may be omitted.

The controller 3 may obtain the propulsion device data from another device other than each marine propulsion device. For example, a flow meter may be installed in the hose connected to the cooling water pathway of each marine propulsion device. The controller 3 may obtain the propulsion device data by communicating with the flow meter.

In the above-described preferred embodiments, the controller 3 determines whether or not the pressure of water in the water cooling pathway of each marine propulsion device is greater than the threshold. However, the controller 3 may determine whether or not the flow rate of water in the cooling water pathway of each marine propulsion device is greater than a threshold. Here, the flow rate of water in the cooling water pathway refers to the amount of water flowing through the cooling water pathway per unit time. The controller 3 may calculate the flow rate of water in the cooling water pathway based on the pressure of water in the cooling water pathway. Alternatively, a water flow rate sensor may be installed in the cooling water pathway, and the controller 3 may obtain the flow rate of water detected by the water flow rate sensor as the propulsion device data. The controller 3 may determine the time to close each valve based on the flow rate of water in the cooling water pathway of each marine propulsion device. Alternatively, the controller 3 may determine the time to close each valve based on a combination of at least two of the pressure of water, the flow rate of water, and the concentration of salt in the water.

The required time data may define a relationship between the flow rate of water in the cooling water pathway and the required time. In the required time data, for instance, the required time may decrease with an increase in the flow rate of water in the cooling water pathway. The controller 3 may determine the required time to flush each marine propulsion device based on the flow rate of water in the cooling water pathway of each marine propulsion device. Alternatively, the required time data may define a relationship between the temperature of water in the cooling water pathway and the required time. In the required time data, for instance, the required time may decrease with an elevation in temperature of the water in the cooling water pathway. The controller 3 may determine the required time to flush each marine propulsion device based on the temperature of the water in the cooling water pathway of each marine propulsion device.

Figure 11:
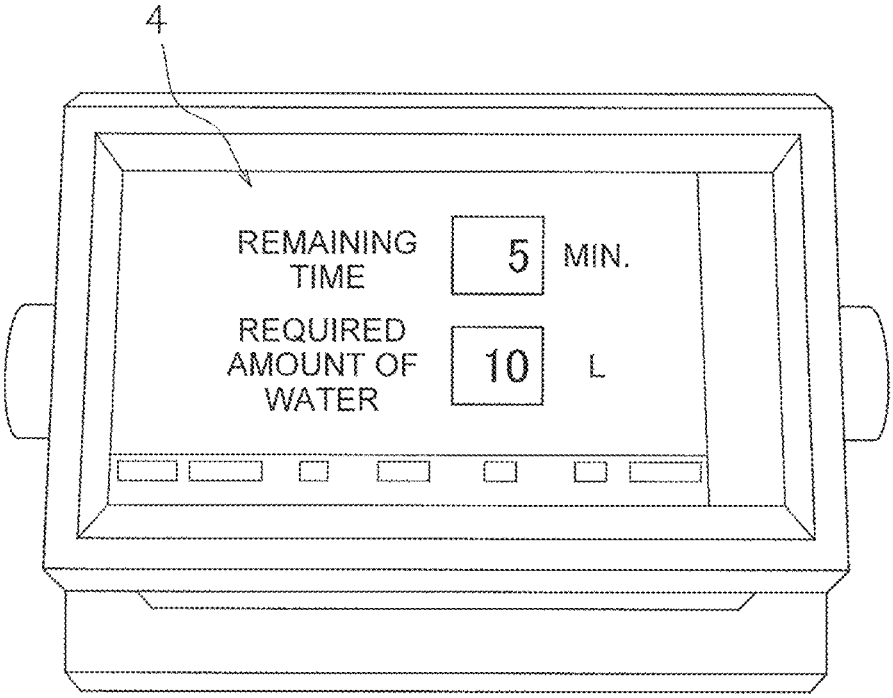
FIG. 11 is a diagram showing an exemplary display.

The controller 3 may cause the display 4 to show information indicating a status of flushing. FIG. 11 is a diagram showing an example of the display 4. As shown in FIG. 11, the controller 3 may cause the display 4 to show a remaining time to the end of flushing. The controller 3 may cause the display 4 to show the amount of water required until the end of flushing. The controller 3 may calculate the remaining time to the end of flushing and the amount of water required until the end of flushing based on the pressure of water in the cooling water pathway.

The controller 3 may cause the display 4 to show an explanation of the flushing procedure. The explanation of the flushing procedure may include, for instance, explanation of stopping the engine, tilting up each marine propulsion device, supplying water, and so forth. The controller 3 may cause the display 4 to show an error message such as failure of flushing. The controller 3 may cause the display 4 to show an alert when the water pressure P0 in the inlet 41 of the water control device 2 is less than or equal to the threshold Th0 in the steps S103, S203, and S303 described above.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for flushing a cooling water pathway of a marine propulsion device with water supplied from a water source, the system comprising:

a water control device connected to the water source and the cooling water pathway of the marine propulsion device to control a supply of the water from the water source to the cooling water pathway; and a controller configured or programmed to:

control the water control device;

cause the water control device to supply the water from the water source to the cooling water pathway so as to flush the cooling water pathway;

obtain propulsion device data including at least one of a pressure of the water in the cooling water pathway, a flow rate of the water in the cooling water pathway, and a concentration of salt contained in the water in the cooling water pathway; and determine whether or not to stop the supply of the water using the water control device based on the propulsion device data.

2. The system according to claim 1, wherein the propulsion device data includes either the pressure of the water or the flow rate of the water; and the controller is further configured or programmed to stop the supply of the water using the water control device after an elapse of a predetermined period of time since a point of time in which either the pressure of the water or the flow rate of the water has become greater than a predetermined threshold.

3. The system according to claim 2, wherein the controller is further configured or programmed to determine the predetermined period of time based on either the pressure of the water or the flow rate of the water.

4. The system according to claim 2, wherein the marine propulsion device is attached in a tiltable manner to a watercraft;

the propulsion device data includes a tilt angle of the marine propulsion device; and the controller is configured or programmed to determine the predetermined period of time based on the tilt angle.

5. The system according to claim 2, wherein the propulsion device data includes an engine temperature of the marine propulsion device; and the controller is configured or programmed to determine the predetermined period of time based on the engine temperature.

6. The system according to claim 1, wherein the propulsion device data includes the concentration of salt contained in the water; and the controller is further configured or programmed to stop the supply of the water using the water control device when the concentration of salt contained in the water becomes less than a predetermined threshold.

7. The system according to claim 1, wherein the propulsion device data includes information indicating whether or not an engine of the marine propulsion device is being operated or stopped; and the controller is further configured or programmed not to start the supply of the water using the water control device when the engine is being operated.

8. The system according to claim 1, further comprising:

a display in communication with the controller; wherein the controller is further configured or programmed to cause the display to show information indicating a status of flushing the cooling water pathway.

9. The system according to claim 1, wherein the controller is further configured or programmed to:

determine whether or not to end flushing the cooling water pathway based on the propulsion device data; and shut down the system when it is determined to end flushing the cooling water pathway.

10. The system according to claim 1, wherein the water control device includes a plurality of valves respectively connected to water cooling pathways of a plurality of marine propulsion devices; and the controller is further configured or programmed to:

obtain the propulsion device data of each of the plurality of marine propulsion devices; and sequentially open and close the plurality of valves based on the propulsion device data of each of the plurality of marine propulsion devices.

11. The system according to claim 10, wherein the plurality of marine propulsion devices include a first marine propulsion device and a second marine propulsion device;

the plurality of valves include:

a first valve connected to the cooling water pathway of the first marine propulsion device; and a second valve connected to the cooling water pathway of the second marine propulsion device;

the controller is further configured or programmed to:

supply the water from the water source to the cooling water pathway of the first marine propulsion device by opening the first valve;

obtain the propulsion device data of the first marine propulsion device;

determine whether or not to close the first valve based on the propulsion device data of the first marine propulsion device;

supply the water from the water source to the cooling water pathway of the second marine propulsion device by opening the second valve after closing the first valve;

obtain the propulsion device data of the second marine propulsion device; and determine whether or not to close the second valve based on the propulsion device data of the second marine propulsion device.

* * * * *